United States Patent [19]

Drinkuth

[11] 4,189,090

[45] Feb. 19, 1980

[54] AUTOMATIC DAMPER ASSEMBLY

[76] Inventor: Gerald E. Drinkuth, P.O. Box 444, Rumford, Me. 04276

[21] Appl. No.: 835,827

[22] Filed: Sep. 22, 1977

[51] Int. Cl.[2] ..... G05D 23/12

[52] U.S. Cl. ..... 236/1 G

[58] Field of Search ..... 236/1 R, 1 G, 1 H, 45

[56] References Cited

U.S. PATENT DOCUMENTS

| | | | |
|---|---|---|---|
| 3,273,625 | 9/1966 | Holtzman | 236/1 G |
| 4,039,123 | 8/1977 | Frankel | 236/1 G |

*Primary Examiner*—Patrick D. Lawson

*Attorney, Agent, or Firm*—Cushman, Darby & Cushman

[57] ABSTRACT

An automatic damper for closing the flue of a furnace during periods of non-combustion utilizing a pivotally mounted linkage arm spring biased against a motor driven cam to effect rotation of the damper to open and close the flue. Switches, responsive to the position of the damper operate to selectively activate the motor in accordance with the combustion state of the furnace. Provisions are also described for inhibiting combustion in the furnace when the damper is not in an open position.

12 Claims, 3 Drawing Figures

FROM BURNER CONTROL
TO BURNER MOTOR
120 VAC
10
12
14
16
18
18a
18b
18c
20
22
24
24a
24b
24c
26
28
30
32
34
36
38
40
42
44
46
48
50

AUTOMATIC DAMPER ASSEMBLY

BACKGROUND OF THE INVENTION

It has been found that one of the major sources of inefficiency in heating furnaces is heat loss through the furnace flue during periods when no combustion is taking place in the furnace. Automatic damper assemblies for opening and closing a flue in accordance with the combustion state of a furnace or fireplace are well known in the art. Prior art damper systems, however, have been relatively complex and expensive. Examples of prior art automatic damper assemblies are described in U.S. Pat. Nos. 1,773,585 issued to Klockau on Aug. 19, 1930, 1,927,670 issued to Morrow on Sept. 19, 1933, 2,053,750 issued to Terry on Sept. 8, 1936, 2,117,787 issued to Bock on May 17, 1938, 2,130,491 issued to Gilliland on Sept. 20, 1938, 2,154,644 issued to Sweatt on Apr. 18, 1939, 2,155,642 issued to Dewey on Apr. 25, 1939, 2,165,488 issued to Klimis on July 11, 1939, 2,224,705 issued to Stringer on Dec. 10, 1940. 2,226,081 issued to Stuart on Dec. 24, 1940, 2,243,715 issued to Miller on May 27, 1941, 2,381,437 issued to Crew et al on Aug. 7, 1945, 2,446,834 issued to Kaufman on Aug. 10, 1948, 2,508,885 issued on Mackay on May 23, 1950, 2,692,640 issued to Field on Oct. 26, 1954, 2,856,992 issued to Bartels on Oct. 21, 1958, 3,010,451 issued to Hodgins on Nov. 28, 1961, 3,580,238 issued to Diehl on May 25, 1971, 3,773,028 issued to Schreibeis on Nov. 20, 1973, 4,005,820 issued to Cress on Feb. 1, 1977.

The present invention provides a simple and inexpensive damper assembly for controllably closing the flue of electrically ignited furnace. A damper is rotatably mounted within the flue, and cooperates with a linkage assembly including a first linkage arm pivotally mounted and biased against a motor driven cam such that the position of the linkage arm changes in accordance with rotation of the cam. Control signals are generated to the motor to effect rotation of the cam in accordance with the combustion state of the furnace.

More specifically, burner control signals to the furnace burner indicating a demand for combustion activate a relay in the damper assembly. A switch, cooperating with the cam, completes a current path to the motor from the normally closed (unactivated) set of relay contacts when the damper is in other than a closed position. Another switch cooperating with the linkage assembly, completes a current path from the normally open set of relay contacts (closed when activated) to the motor when the damper is in other than open position, and when the damper is in the open position completes a current path from the normally open set of contacts to the furnace burner to enable combustion.

The damper assembly is contained in a unitary module, for each installation into an existing furnace flue and control system. Further, it should be appreciated, that the second switch provides an interlock system, which prevents combustion in furnace unless the damper assembly is fully opened. Further, the use of the cam-linkage mechanism for rotating the damper provides an inherent delay during which the gases remaining from combustion, even after the combustion itself has ceased, are purged (allowed to escape), thus alleviating the rather complex delay mechanisms utilized in the prior art systems.

A preferred exemplary embodiment of the present invention will hereinafter be described with reference to the accompanying drawings in which like numerals denote like elements, and:

Figures 1, 3:
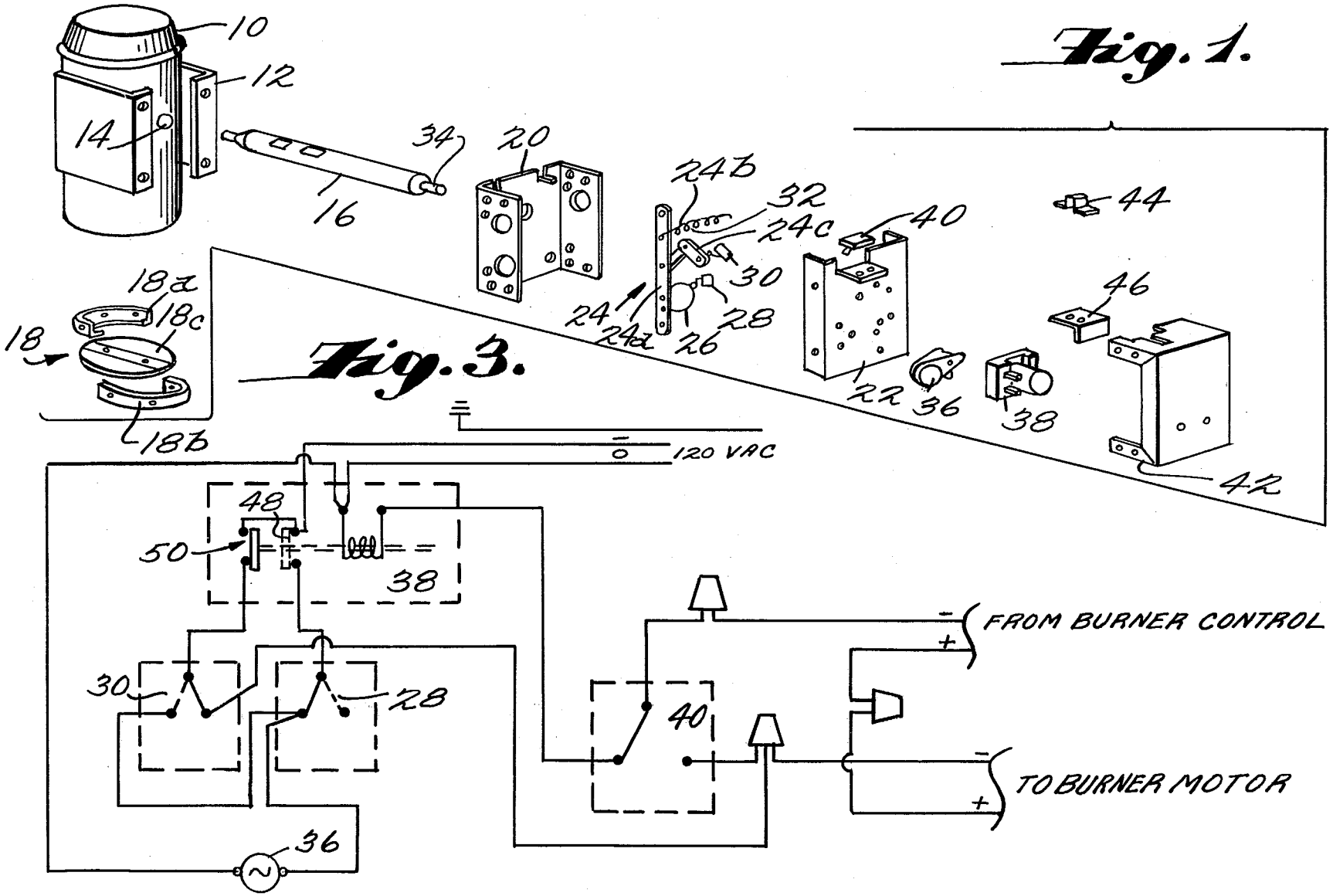
FIG. 1 is an exploded perspective view of the preferred exemplary embodiment.
FIG. 3 is a schematic diagram of the control circuitry for the motor.
Figure 2:
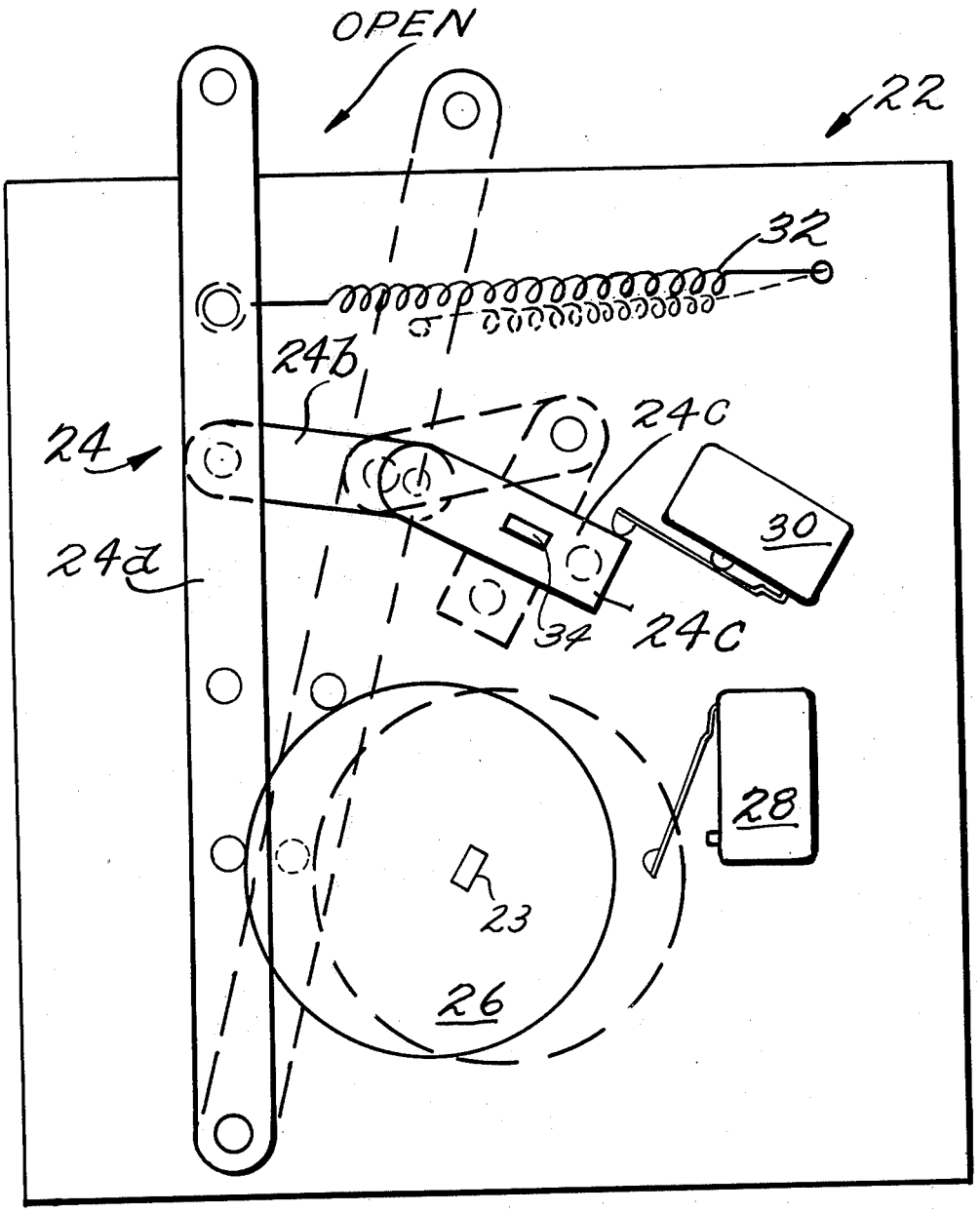
FIG. 2 is a elevational view of the cam and linkage assembly.

Referring now to FIGS. 1 and 2, a section of duct 10 is adapted to be inserted into the flue of a furnace (not shown) duct 10. Duct 10 has affixed thereto a mounting yoke 12, and has a hole 14 bored in each side to receive a shaft 16. A damper assembly 18 including seats **18*a* and 18*b* and a disc 18*c* are received in the interior of duct 10. Disc 18*c* is attached to shaft 16, suitably by bolting or sheet metal screws, and adapted to rotate with the shaft. A back plate 20 having an aperture to pass shaft 16 is fixed to mounting yoke 12, again suitably by bolting or screws. A mounting plate 22 is coupled to back plate 20, also suitably by bolting or sheet screws. A linkage assembly, generally indicated as 24, a cam 26 and switches 28 and 30 are maintained between back plate 20 and mounting plate 22. Linkage assembly 24 suitably comprises a first linkage arm 24*a*, pivotally mounted to the interior of plate 22, and biased by a spring 32 against cam 26. Linkage arm 24*b* is pivotally coupled at one end to arm 24*a*, and at the other end to one end of arm 24*c*. Shaft 16 preferably has a flatened or keyed end 34, which mates with a corresponding aperture in linkage arm 24*c*. Shaft 16, and hence damper 18, thus rotate in accordance with movement of arm 24*c*. Switches 28 and 30 are also mounted on the interior of mounting plate 22, and cooperate with cam 26 and linkage arm 24*c*, as will be explained. A motor 36, suitably a 120 volt A.C. syncronous motor operating at 1-$\frac{1}{3}$ rpm is mounted on the exterior side of mounting plate 22, and includes a shaft 23 which extends through a corresponding aperture in mounting plate 22 and engages cam 26. As will hereinafter be more fully explained, motor 36 is utilized to controllably rotate cam 26 to effect opening and closing of damper 18 via linkage assembly 24. A relay 38 and a further switch 40 are also mounted on mounting plate 22. A protecting cover 42 is fixed to back plate 20, sandwiching mounting plate 22 and the various elements mounted thereon. A slider 44 and tripper 46 are also provided for manual operation of switch 40**.

Switches 28, 30, and 40, relay 38, and motor 36 are electrically interconnected as shown in FIG. 3. In conventional electrically ignited furnaces, signals indicating a demand for combustion from, for example, a thermostat, are applied to a burner control (not shown) which, in response, applies power (generally 120 VAC) to a burner motor to initiate combustion. Combustion is inhibited in the absence of such applied power. The damper control system of the present invention is coupled into the power line between the burner control and the burner motor. The A.C. high (hot) conductor from the burner control is connected (suitably by a wire nut) through the pole of switch 40. Switch 40 is suitably a 240 volts A.C., 20 amp rated, single pole, double throw switch. One throw contact (normally open) of switch 40 is connected, again suitably by a wire nut, to the outgoing A.C. high (hot) conductor to the burner motor. The A.C. low (neutral) line from the burner control to burner motor is, in effect, left intact. The other contact (normally open) of switch 40 is connected to one terminal of the activation coil of relay 38. The other terminal of the relay (38) activation coil is connected to the A.C. low (neutral) conductor of a separator 120 VAC line or other suitable power source, not associated with the control of the burner motor. The A.C. low (neutral) conductor of the separate power line is also connected to one terminal of motor 36. Relay 38 is suitably a 240 volt A.C., 20 amp, single pole, double throw relay, having a 120 volt A.C. rated coil, having associated therewith first and second sets of contacts 48 and 50 respectively. When not activated, contacts 48 are closed and contacts 50 open. When activated contacts 50 are closed and contacts 48 open. One contact of each set of contacts associated with relay 38 (collectively operating as the relay pole) is connected in common to the A.C. high (hot) conductor of the separate power line. The other contacts of sets of contacts 48 and 50 are connected to the poles of switches 28 and 30 respectively.

Switch 28 is suitably a 120 volt A.C. 5 amp rated, single pole, single throw switch. The throw contact is connected to motor 36. As will be explained, switch 30 is normally closed, opened only when damper 18 is in the closed position.

Switch 30 is suitably a 240 volts A.C., 20 amp rated, single pole, double throw switch. One throw contact (normally closed) is connected to motor 36. The second (normally open) throw contact is connected to the outgoing A.C. high (hot) conductor to the burner motor. As will be explained, contact is normally completed between the pole and throw contact connected to motor 36, contact to the motor being broken and contact to the burner motor being made only when the damper assumes the open position.

With reference to FIGS. 2 and 3, the operation of the automatic damper assembly will be explained. In the normal standby condition, while no combustion is taking place in the furnace, damper 18 closes duct 10 (FIG. 1). Linkage assembly 24 and cam 26 maintain the positions shown in dotted lines in FIG. 2.

Switch 28 is disposed on mounting plate 22 such that cam 26 engages a switch arm to break the normally closed contact (to the motor) when the cam assumes the position corresponding to the damper being closed. Switch 30, on the other hand, is disposed on mounting plate 22 such that a switch arm is engaged by linkage arm **24*c* when the damper is in an open position, tripping the switch from its normally closed position (to the damper assembly motor) to its normally open position (to the burner motor). When linkage arm 24*c*** disengages the switch arm, the normally closed contacts are again closed.

Switch 40 is a manual override switch, which operates to disengage the damper assembly from the control of the burner control. Slider 44 and tripper 46 require that linkage arm **24*a* be in position corresponding to the open damper before switch 40** can be tripped to, in effect, turn off the damper assembly.

With switch 40 in its normally closed position, when the burner control provides power on the conductor, indicating a demand for combustion, a current flows through the activating coil of relay 38. As noted above, relay 38, when unactivated closes contacts 48, and when activated closes contacts 50. Thus, when the activation coil is energized, relay 38 completes a circuit to switch 30. Assuming the damper to be in the stand-by (closed) position, switch 30 completes a current path to motor 36. Thus, when relay 38 closes contacts 50, motor 36 is energized, to rotate cam 26. Rotation of cam 26, in turn effects a pivotal movement of linkage arm **24*a*, which in turn causes movement of arms 24*b* and 24*c* to rotate the damper. The rotation continues until the damper assumes the open position, and linkage arm 24*c* engages the switch arm of switch 30 to break the connection to the motor and close the normally opened contacts, thereby completing the circuit to the burner motor and allowing combustion. Again, it should be appreciated, the use of a single pole, double throw switch 30** provides a fail safe against combustion with the damper being closed.

When the demand for combustion ceases, the burner control ceases to provide power to the burner motor. Current therefore ceases to flow through the activation coil of relay 38. Contacts 50 are thus opened and contacts 48 closed. Since the damper is in an opened position, switch 28 is closed. Thus, a current path to motor 36 is completed upon closure of contacts 48. Motor 36 therefore rotates cam 26, and the tension from spring 32 causes linkage 24 to follow the cam and rotate damper 18. As damper 18 is rotated from the opened position, linkage arm **24*c* disengages the switch arm of switch 30 and switch 30 reestablishes its normally closed contact to motor 36, preparing the damper assembly for recycling upon subsequent demand for combustion and cam 26 is rotated until it attains the position corresponding to the damper being closed, whereupon it engages the switch arm of switch 28 to break the current path to motor 36**. Thus, the damper assembly automatically closes the furnace flue when no combustion is taking place in the furnace.

It should be appreciated that since the combustion is extinguished substantially upon the termination of the signal from the burner control, a finite period is required for the cam to rotate through the angle necessary to move the damper from open to closed position. Such period allows time for the combustion gases to be purged from the flue. The speed of motor 36 is chosen accordingly. In the presently preferred exemplary embodiment, the motor operates at 1-$\frac{1}{3}$ rpm.

It will be understood that the above description is of illustrative embodiments of the present invention, and that the invention is not limited to this specific shown. Various modifications can be made in the design and arrangement of the elements as will be apparent to those skilled in the art, without departing from the spirit or scope of the invention as expressed in the appended claims.

What is claimed is:

1. A damper assembly for controllably closing the flue of an electrically ignited furnace comprising:

a damper, rotatably mounted within said flue;

a motor responsive to control signals applied thereto;

a cam driven by said motor;

a first linkage arm biased against said cam, whereby the position of said first linkage arm changes in accordance with the rotation of said cam;

a further linkage assembly, coupling said damper to said first linkage arm, to effect rotation of said damper in accordance with the position of said first linkage arm; and means for generating control signals to said motor to effect rotation of said cam in accordance with the combustion state of said furnace.

2. The damper assembly of claim 1 wherein said further linkage assembly comprises:

second and third linkage arms, said second linkage arm being pivotally connected to one end to said first said linkage arm, and at the other end to said third linkage arm, said third linkage arm being fixedly connected to said damper, and adapted for movement about the axis of rotation of said damper;

movement of said first linkage arm effecting said motion of said third linkage arm to rotate said damper.

3. The damper assembly of claim 2 wherein said furnace includes burner means for controllably providing combustion and burner control means for generating a signal to activate said burner means, wherein further, said means for generating control signals comprises:

means responsive to a signal indicative of said burner control signal, for selectively closing a first set of contacts during periods of demand for combustion and closing a second set of contacts during periods wherein no combustion is demanded;

a first switch, responsive to the position of said damper, for completing a current path from said first set of contacts to said motor when said damper is in other than a first predetermined position, and completing a current path from said first set of contacts to said burner means when said damper is in first predetermined position; and a second switch, response to the position of said damper, for completing a current path from said second set of contacts to said motor when said damper is in other than a second predetermined position;

whereby during periods of demand for combustion, control signals are applied to said motor to rotate said cam until said damper achieves said first predetermined position, whereupon said motor is deenergized and said burner means is enabled, and when the demand for combustion ceases, said burner means is inhibited and control signals applied to said motor to rotate said cam until said damper achieves said second predetermined position.

4. The damper assembly of claim 3, wherein said first linkage arm is spring biased against said cam.

5. The damper assembly of claim 2, wherein said first linkage arm is spring biased against said cam.

6. The damper assembly of claim 1 wherein said furnace includes burner means for controllably providing combustion and burner control means for generating a signal to activate said burner means, wherein further said means for generating control signals comprises:

means responsive to a signal indicative of said burner control signal, for selectively closing a first set of contacts during periods of demand for combustion and closing a second set of contacts during periods wherein no combustion is demanded;

a first switch, responsive to the position of said damper, for completing a current path from said first set of contacts to said motor when said damper is in other than a first predetermined position, and completing a current path from said first set of contacts to said burner means when said damper is in first predetermined position; and a second switch, response to the position of said damper, for completing a current path from said second set of contacts to said motor when said damper is in other than a second predetermined position;

whereby during periods of demand for combustion, control signals are applied to said motor to rotate said cam until said damper achieves said first predetermined position, whereupon said motor is deenergized and said burner means is enabled, and when the demand for combustion ceases, said burner means is inhibited to control signals applied to said motor to rotate said cam until said damper achieves said second predetermined position.

7. The damper assembly of claim 6, wherein said first linkage arm is spring biased against said cam.

8. The damper assembly of claim 1, wherein said first linkage arm is spring biased against said cam.

9. A damper assembly comprising:

a duct adapted for coupling into the flue of a furnace;

a shaft rotatably mounted transversely in said duct;

a damper, coupled to said shaft, adapted for rotation about said shaft within said duct;

a motor mounted on said duct;

a cam driven by said motor;

a first linkage arm moveably mounted on said duct and biased against said cam such that rotation of said cam effects movement of said first linkage arm;

second and third linkage arms, said second linkage arm being pivotally mounted at one end to said first linkage arm and at the other end to said third linkage arm, said third linkage arm being fixed to said shaft and adapted to effect rotation of said shaft in accordance with said motion of said first linkage arm; and means for controllably activating said motor in accordance with the combustion state of said furnace.

10. The damper assembly of claim 9 wherein said means for activating comprises:

a relay, mounted to said duct and adapted to receive control signals from said furnace indicative of a demand for combustion, said relay normally closing a first set of contacts, and opening said first set of contacts and closing a second set of contacts in response to said demand signal, said first and second set of contacts being adapted for coupling to a power source;

a first switch, mounted on said duct and cooperating with said cam for completing a current path to said motor from said first set of contacts when said damper is in other than a closed position; and a second switch, mounted on said duct and cooperating with said third linkage arm, for completing a current path from said second set of contacts to said motor when said damper is in other than an open position and when said damper is in said open position completing a current path from said second set of contacts to said furnace to enable combustion in said furnace.

11. The damper assembly of claim 10, wherein said first linkage arm is spring biased against said cam.

12. The damper assembly of claim 9, wherein said first linkage arm is spring biased against said cam.

* * * * *